US006035559A

United States Patent [19]

Freed et al.

[11] Patent Number: 6,035,559

[45] Date of Patent: Mar. 14, 2000

[54] SHOE WITH CIRCULAR PAD IN THE SOLE TO RELIEVE TWISTING STRESSES ON THE ANKLE

[75] Inventors: Yariv Gary Freed; Jon Seddon; Jack Goldberg, all of Victoria, Australia

[73] Assignee: Rotasole Pty. Ltd., Caulfield, Australia

[21] Appl. No.: 09/051,656

[22] PCT Filed: Oct. 9, 1996

[86] PCT No.: PCT/AU96/00634

§ 371 Date: Jun. 15, 1998

§ 102(e) Date: Jun. 15, 1998

[87] PCT Pub. No.: WO97/13422

PCT Pub. Date: Apr. 17, 1997

[30] Foreign Application Priority Data

| | | | |
|---|---|---|---|
| Oct. 11, 1995 | [AU] | Australia | PN 5918 |
| Aug. 21, 1996 | [AU] | Australia | PO 1810 |

[51] Int. Cl.[7] ..... A43B 5/00; A43B 23/28

[52] U.S. Cl. ..... 36/134; 36/115; 36/59 R

[58] Field of Search ..... 36/61, 62, 132, 36/134, 136, 128, 126, 114, 115, 116, 59 R

[56] References Cited

U.S. PATENT DOCUMENTS

| | | | |
|---|---|---|---|
| 3,354,561 | 11/1967 | Cameron | 36/134 |
| 3,481,332 | 12/1969 | Arnold . | |
| 3,680,231 | 8/1972 | Dymond . | |
| 3,707,047 | 12/1972 | Nedwick . | |
| 3,757,437 | 9/1973 | Cameron . | |
| 3,824,710 | 7/1974 | Egtvedt | 36/59 R |
| 4,653,206 | 3/1987 | Tanel | 36/134 |
| 4,660,304 | 4/1987 | Tanel | 36/134 |
| 4,670,997 | 6/1987 | Beekman . | |
| 4,890,398 | 1/1990 | Thomasson | 36/114 |
| 5,079,968 | 1/1992 | Starner . | |
| 5,313,718 | 5/1994 | McMahon et al. | 36/128 |
| 5,392,537 | 2/1995 | Goldberg | 36/134 |

FOREIGN PATENT DOCUMENTS

| | | |
|---|---|---|
| 165 74 69038 | 11/1975 | Australia . |
| 34068/89 | 11/1989 | Australia . |
| 0 363 217 | 4/1990 | European Pat. Off. . |
| 2 565 469 | 12/1985 | France . |
| 1 385 617 | 2/1975 | United Kingdom . |
| 1 387 012 | 3/1975 | United Kingdom . |
| WO92/10954 | 7/1992 | WIPO . |
| WO94/16588 | 8/1994 | WIPO . |
| WO96/18317 | 6/1996 | WIPO . |

*Primary Examiner*—Paul T. Sewell
*Assistant Examiner*—J. Mohandesi
*Attorney, Agent, or Firm*—Knobbe, Martens, Olson & Bear, LLP

[57] ABSTRACT

The invention relates to a sole for footwear having a structure for minimizing injury to the wearer from twisting or turning movements which may occur during sporting activities, and/or for enhancing performance by assisting rotational movement of the foot. A first invention is a shoe sole comprises a turntable within the sole and connected thereto by a resilient web which provides a seal between the periphery of the turntable and sole. The web is resiliently deformable in response to rotation of the turntable in either direction from a rest position to apply resilient bias to restore the turntable towards it rest position. There may be additional biasing means. There are ten further disclosures of the turntable involving: using glue to fix the turntable and to provide the seal and resilient bias; a separate turntable having a wiper seal with the sole and additional biasing means; means for limiting the extent of the rotational movement; coil and leaf springs and interengaging portions of the sole and turntable to provide the resilient bias; a circular race of ball bearings to support the turntable; multiple turntables; means for fixing cleats or studs to the turntable. A second invention is a sole having annular rows of deformable fins which permit limited rotation of the sole.

8 Claims, 15 Drawing Sheets

SHOE WITH CIRCULAR PAD IN THE SOLE TO RELIEVE TWISTING STRESSES ON THE ANKLE

FIELD OF THE INVENTION

The present invention relates to footwear and more particularly to a sole for footwear having a structure for minimising injury to the wearer as may arise from twisting or turning movements which may occur during certain sporting activities, and/or for enhancing performance by assisting rotational movement of the foot.

BACKGROUND OF THE INVENTION

A footwear sole incorporating a turntable to minimise injuries of the type just discussed is disclosed in International patent applications PCT/AU91/00590 and PCT/AU94/00002 ("the earlier applications"), the disclosure of which is hereby incorporated by reference. The present invention relates to further developments of, and/or variations of, the general concepts disclosed in these earlier applications.

In the earlier applications a turn table of a generally circular shape is incorporated into a recess in the sole and is capable of rotation through a limited angular extent as defined by a series of interengaging projections and recesses between the turntable and the structure of the sole. The actual effect of the turntable in practice is to allow the sole to pivot about the turnable if the foot is turned or twisted when the turntable is in contact with the ground. The turntable is also subject to a resilient bias which has the effect of returning it to its initial position relative to the sole when the sole is lifted from the ground. The resilient bias may be applied by integral elastomeric projections extending from the turntable as disclosed in application PCT/AU91/00590, or by means of a coil spring assembly incorporated between the underside of the turntable and the sole as described in application PCT/AU94/00002.

SUMMARY OF THE INVENTION

A first aspect of the present invention has particular applicability for use in environments where the footwear is likely to be used on playing surfaces which are liable to become muddy or which are composed of loose particulate material.

According to a first aspect of the invention, there is provided a sole for footwear, said sole having a recess within which is mounted a turntable for rotation in either direction of rotation from a rest position, with the angular extent of rotation from the rest position being restricted, and means interposed between the turntable and sole for preventing ingress of mud and dirt into the recess.

Further according to this aspect of the invention, there is provided a sole for footwear having a turntable within the sole and connected thereto by a resilient web which provides a seal between the periphery of the turntable and the sole, said web being resiliently deformable in response to rotation of the turntable in either direction from a rest position to apply resilient bias to the turntable to restore the turntable towards its rest position.

A second aspect of the present invention relates to various biasing arrangements which can be used with the turntable.

According to the second aspect of the invention, there is provided a sole for footwear comprising a recess with a turntable mounted therein for rotation in either direction from a rest position, means for restricting rotation of the turntable, and resilient means for applying a bias to restore the turntable to its rest position after rotation.

A third aspect of the present invention relates to the incorporation of a turntable which is rotatable through discrete steps rather than being subject to a resilient bias.

According to the third aspect, there is provided a sole for footwear comprising a recess, and a turntable mounted for rotation within the recess, said turntable being rotatable through discrete steps in either direction of rotation through a restricted angle at each stepwise rotation.

Although the incorporation of the turntable provides a particularly effective means of preventing injuries arising from twisting or turning movements, to a limited extent the action of the turntable may be achieved by alternative means which provide a similar function to the action of the turntable. Although such means are as unlikely to be effective as the turntable, nevertheless this aspect may have some applicability for a limited range of uses.

Therefore, in accordance with a fourth aspect of the invention, there is provided a sole for footwear having an array of deformable fins which deform to permit limited rotation of the sole about the array of fins in either direction.

BRIEF DESCRIPTION OF THE DRAWINGS

Embodiments of the invention will now be described, by way of example only, with reference to the accompanying drawings, in which.

DETAILED DESCRIPTION OF THE INVENTION

Figure 2:
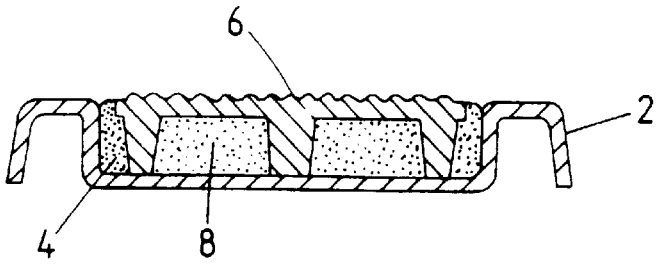
FIG. 2 is a transverse section through the sole of FIG. 1.
Figure 3:
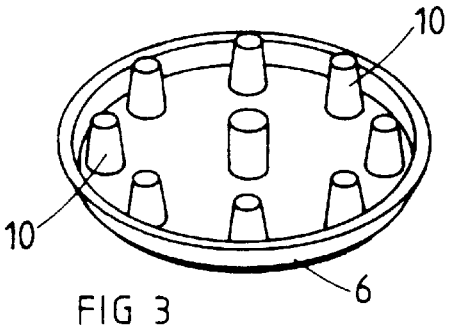
FIG. 3 is a perspective view from aboveshowing a turntable of the sole of FIGS. 1 and 2.
Figure 1:
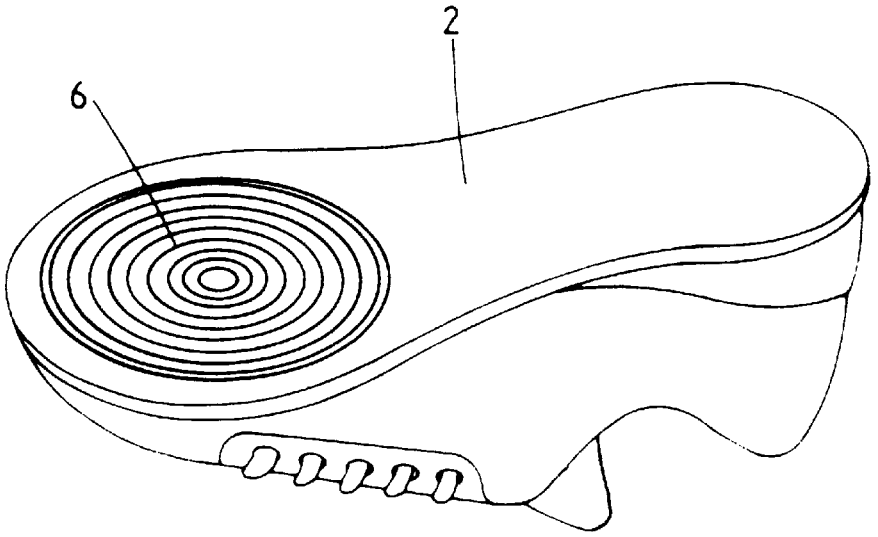
FIG. 1 is an underneath perspective view showing the underside of a shoe sole in accordance with a first embodiment of the invention.

The embodiments initially to be described herein comprise a sole 2 with a recess 4 and a turntable 6 within the recess 4, the turntable 6 being rotatable through a restricted angle in each direction of rotation from a rest position and being resiliently biased to return to that position; by way of example only the turntable 6 can rotate through about 30° in each direction from the rest position. In the embodiment of FIGS. 1 to 3, the resilient bias is applied to the turntable 6 by means of a resiliently deformable body which fills, or substantially fills, the cavity between the turntable 6 and the recess 4 within the sole. A suitable material may be a resilient foam injected into the cavity defined between the turntable and the sole, or a material such as silicon. This is illustrated schematically in FIG. 2 in which the cavity contains a resilient foam filling. The foam, designated 8 in FIG. 2, can be formed by of a material which foams in situ upon injection into the cavity. Advantageously the foam is a self-skinning foam which expands on injection to fill the cavity and which also provides a seal between the turntable 6 and cavity to prevent entry of moisture and dirt into the cavity; injection of the foam can take place through the upper wall of the of the cavity prior to attachment of the shoe upper. The resilient foam 8 will not only act to provide a resilient bias to return the turntable 6 to its original position but will also provide a progressively-increasing resistance to rotation the further the turntable 6 is deflected from is original position and, accordingly, the foam provides a progressive damping effect With this construction it is therefore not necessary to provide positive stops between the turntable 6 and sole 2 to limit rotation. The presence of the foam 8 also acts to retain the turntable 6 within the recess 4 as the foam will tend to bond to the turntable and surrounding structure of the sole on injection into the recess 4. To facilitate bonding of the foam 8 to the turntable 6, the turntable 6 has a number of upstanding integral pegs 10 which project into the cavity. The resistance to rotation provided by the foam can be varied during manufacture by altering the density of the foam.

The configuration illustrated in FIGS. 1 to 3 with the foam filling within the cavity between the turntable 6 and sole 2 has the important effect of preventing ingress of dirt and moisture into the recess 4 and which could impede rotation of the turntable 6.

Figure 4:
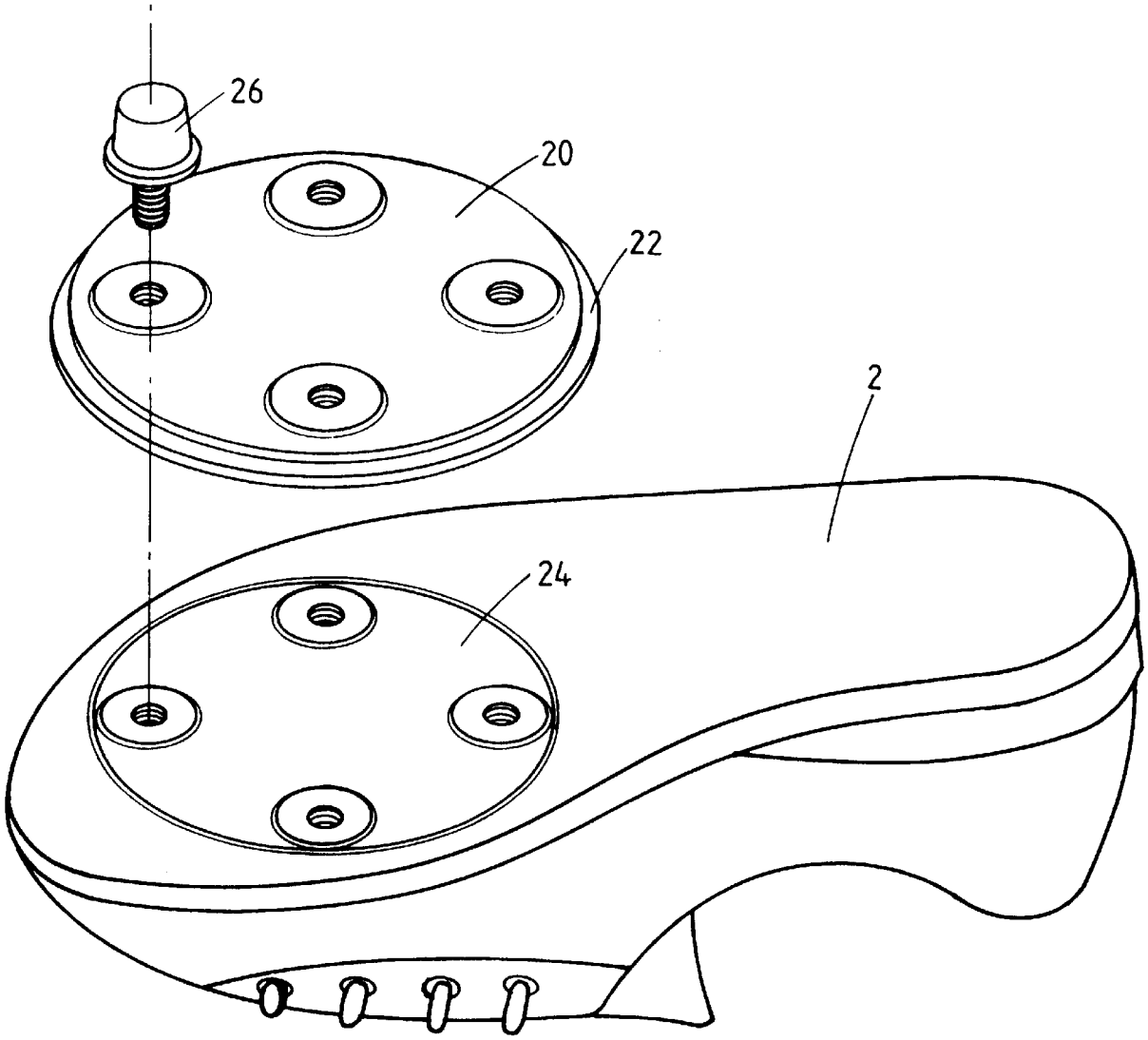
FIG. 4 is an exploded underneath perspective view of a turntable in accordance with a second embodiment of the invention.
Figure 5:
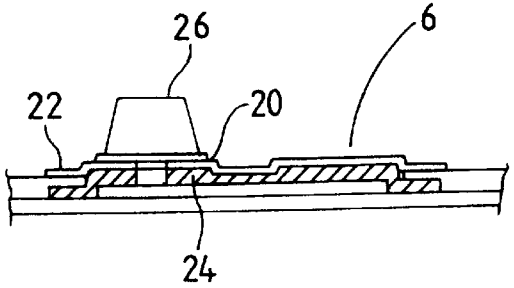
FIG. 5 is a section through the shoe sole and showing the turntable of FIG. 4 in its installed condition.

Ingress of dirt into the recess can also be minimised by means of the arrangement shown in FIGS. 4 and 5 in which the turntable 6 is of two-layer construction. The outer layer 20 has an external annular lip 22 which extends over the edge of the sole bounding the recess. The presence of the lip 22 acts as a wiper which tends to wipe across the under surface of the sole upon rotation of the sole relative to the turntable and as a consequence tends to prevent the ingress of dirt or mud between the lip and sole from entering into the recess. The outer layer 20 of the turntable can be secured to the inner layer 24, after location of the inner layer 24 within the recess, by means of threaded studs 26 screwed through the outer layer 20 into the inner layer 24; although this provides a convenient means of attachment, it will be appreciated that other means can be used to attach the outer layer 20 of the turnable to the inner layer 24 during assembly onto the sole. Instead of acting as a wiper surface, the edge of the lip 22 may be upwardly-formed to constitute an annular rib which is received in an annular groove formed in the of the sole surrounding the turntable. In a combination of the forms just described, part of the edge of the lip 22 may be formed with upwardly-directed diametrically- opposed ribs of arcuate form engaged in diametrically-opposed arcuate grooves in the undersurface of the sole, with the remaining parts of the lip 22 forming wipers across the surface of the sole; in this form, the two arcuate ribs and grooves may be at the forward and rear ends of the turntable.

In the embodiments thus far described, the turntable 6 is separate from the main structure of the sole 2. In the embodiment shown in FIGS. 6 and 7 the turntable 6 and sole 2 are formed as an integral moulding, with the connection between the turntable 6 and sole 2 being defined by a thin annular web 30 extending around the outer edge of the turntable 6. The material from which the sole 2 and turntable 6 is moulded (for example a suitable elastomeric material) is such that the thin web 30 which connects the turntable 6 to the sole 2 will have sufficient resilience to enable the turntable 6 to rotate relative to the sole, such rotation being permitted by resilient deformation of the web 30. This may be facilitated by moulding the web 30 in a generally V-shaped cross-sectional configuration as is illustrated, although other cross-sectional configurations for the web 30 may also achieve a similar effect depending on the characteristics of the material from which the moulding is produced. Again, depending on the characteristics of the material, the resilient deflection of the web 30 during rotation may provide a sufficient resilient bias to restore the turntable 6 to its original position, although if the inherent resilience of the web 30 is insufficient for that purpose, an additional resilient bias may be applied by a spring arrangement or any other resilient means in the manner described in relation to other embodiments of this application and also in the earlier applications. The turntable 6 may, if required, be used in conjunction with appropriate bearing arrangements as described in this application. It is to be noted that with increasing deflection of the turntable 6, the web 30 will deform to provide a greater resistance to rotation and hence an increased dampening effect.

Depending on the actual configuration employed and on the characteristics of the material from which the turntable and sole are moulded, it may be necessary to incorporate stops between the table 6 and adjacent structure of the sole 2 in order to limit the rotation. This will apply if the deformation of the web 30 is not in itself sufficient to provide an adequate limit to the rotation. Suitable stops can be formed by the use of inter-engaging projections and recess between the turntable 6 and overlying structure connected to the sole, for example as described in the earlier applications. This embodiment is particularly advantageous as the turntable 6 and sole 2 can be moulded in one piece which may reduce the number of manufacturing or assembly steps needed. It also provides the important functional advantage that the integral web 30 between the turntable 6 and sole 2 prevents ingress of all moisture and dirt into the recess.

Figure 8:
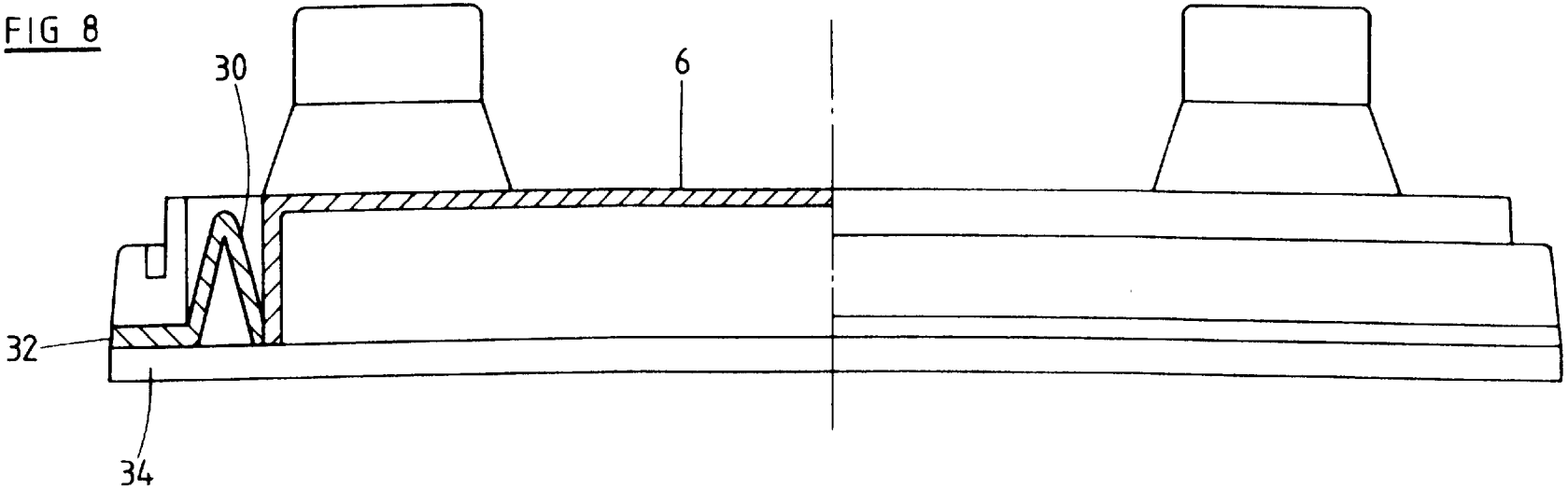
FIG. 8 is a view partially in section showing a turntable carrying a separate connecting web.

Instead of forming the turntable, web, and sole as an integral moulding as just described, the turntable and web may be formed integrally, with the web then being bonded to a pre-formed sole. This may allow greater versatility in the selection of the material for the turntable and web and hence in the resilient characteristics of the web. Alternatively, the web may be formed separately from both the turntable and sole, with the web subsequently being bonded or otherwise fixed to the turntable, and bonded or otherwise fixed to the sole. This permits even greater versatility in the selection of the materials, whereby the sole, web, and turntable can be of different materials; for example the web can be of a soft rubber-like material and the turntable can be of a relatively hard (and harder wearing) material. FIG. 8 illustrates by way of example, a construction where the web 30 is formed separately from the turn table 6 and is bonded to the turntable at the inner edge of the web 30. The outer edge of the web 30 includes an annular flange 32 which is fixed being sandwiched between the adjacent part of the sole and a backing plate 34 which mounts the turntable 6 and spring assembly (if present).

Figure 7:
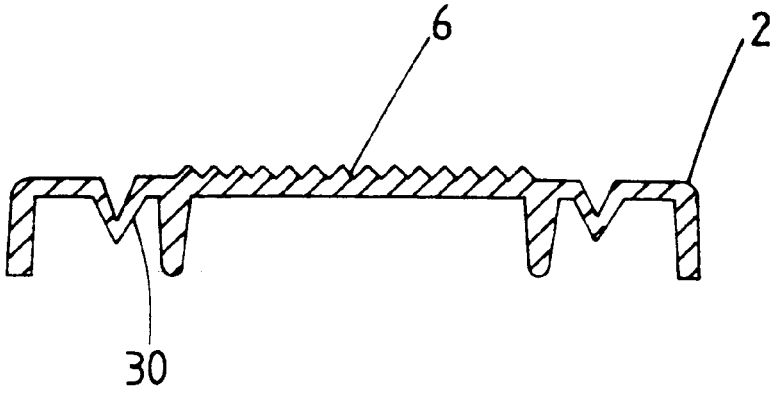
FIG. 7 is a transverse cross-section through the sole of FIG. 6.
Figure 6:
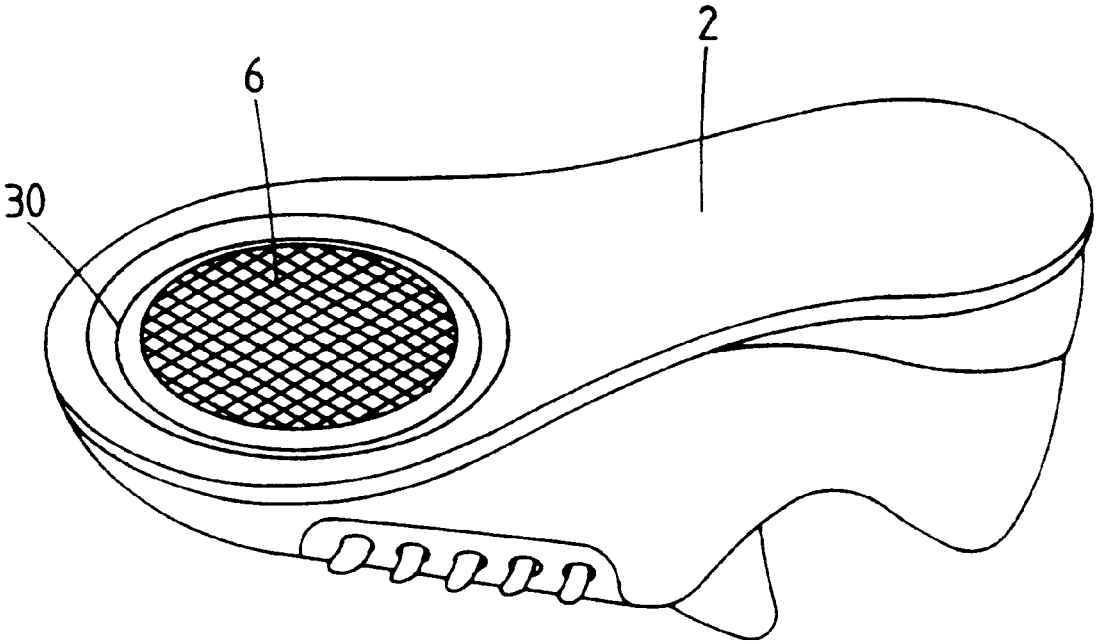
FIG. 6 is a underneath perspective view showing the underside of a shoe sole in accordance with a third embodiment of the invention.
Figure 9:
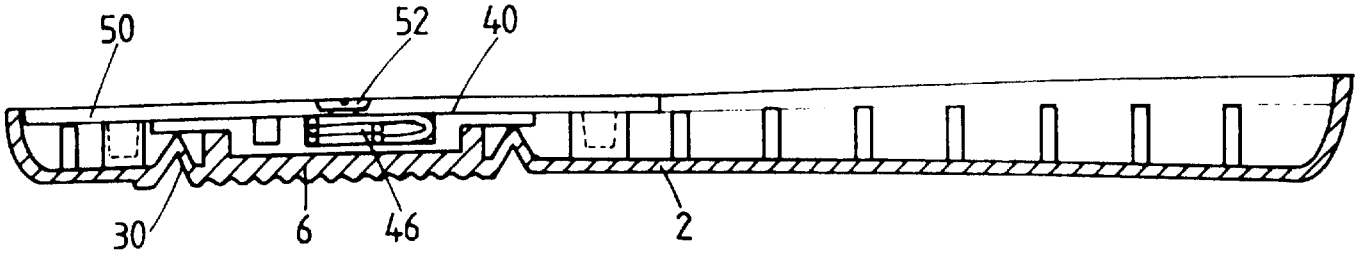
FIG. 9 is a longitudinal section through a shoe sole in accordance with a fourth embodiment of the invention.
Figure 10:
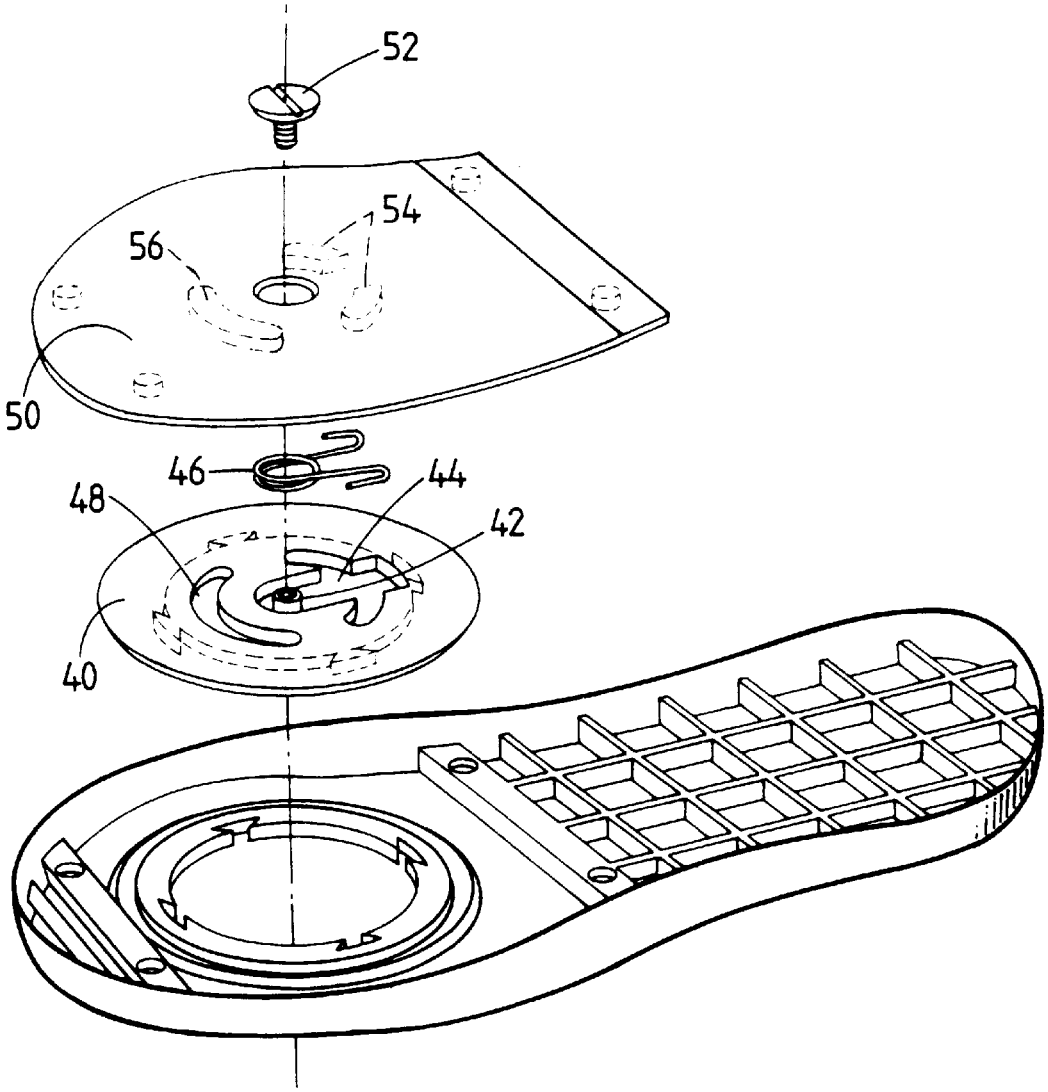
FIG. 10 is an exploded perspective view from above of the embodiment of FIG. 9.

FIGS. 9 and 10 illustrate by way of example, more detail of a construction embodying the principles described with reference to FIGS. 6 and 7. As shown in FIGS. 9 and 10 a disc-like strengthening insert 40 is moulded onto the inside face of the turntable 6 and carries a central boss 42, a recess 44 for a biasing spring 46, and an arcuate recess 48 for use in limiting the extent of relative rotation between the turnable and sole. The insert 40 cooperates with a backing plate 50 fitted onto the upper side of the sole and carrying a pivot screw 52 which is engaged with the boss 42, and also projections 54 to cooperate with the spring 46 and a projection 56 for engagement within the arcuate recess 48 and which acts as a stop to restrict rotation of the assembly consisting of the turntable and insert.

In constructions involving the use of a web between the turntable and sole as described above, it is possible that the web may not, because of its relative thinness and resilience, have the same resistance to wear as the sole and turntable. In this event, the turntable and/or the sole may have an annular flange which projects under the web to shield the web from direct contact with the ground. Instead of shielding the web by means of the annular flange, the web may be shielded by a wiper arrangement, for example of the type described previously in relation to FIGS. 4 and 5.

Figure 11:
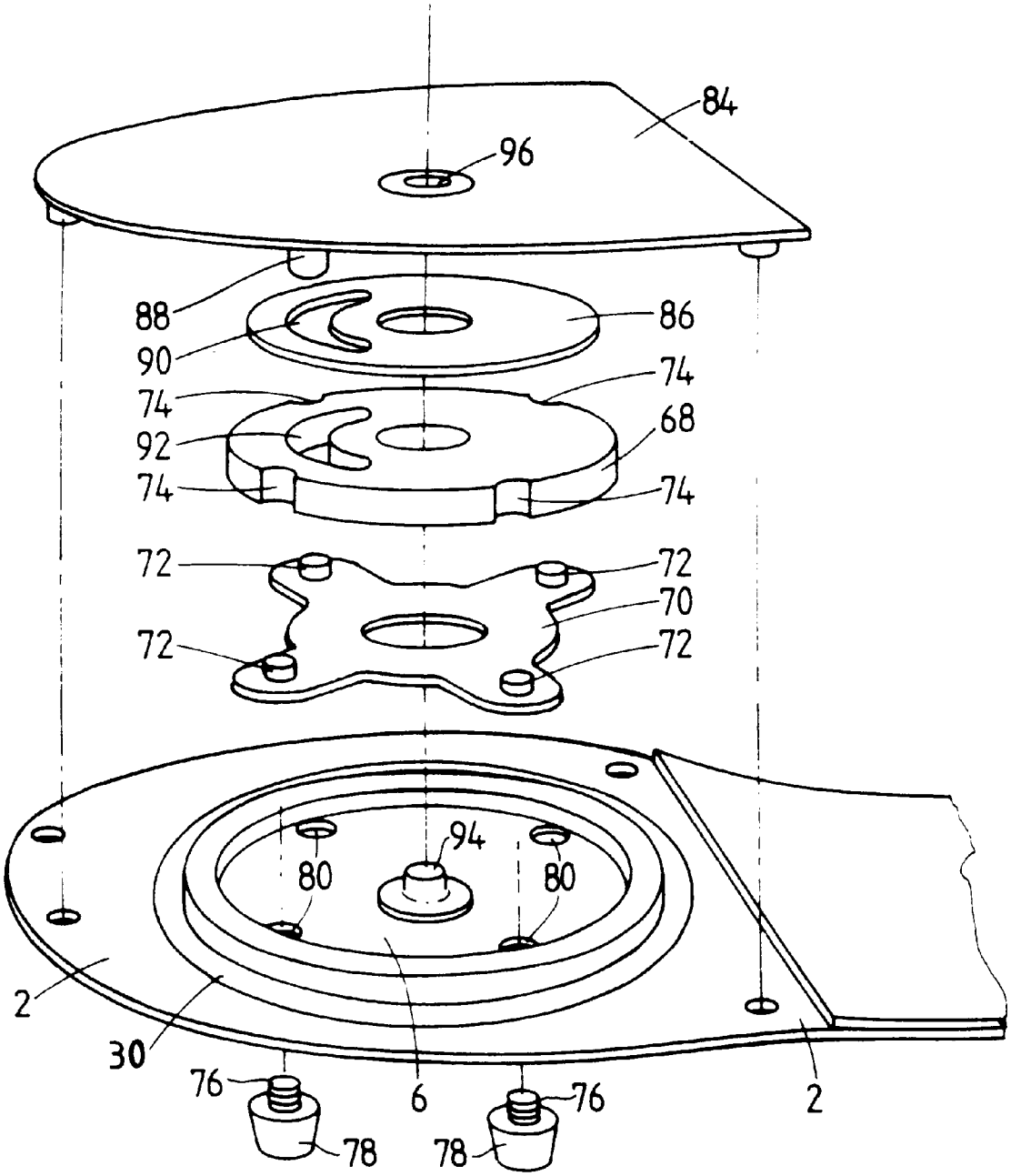
FIG. 11 is an exploded perspective view from above showing a fifth embodiment of the invention.

In the embodiment of FIG. 11, turntable 6 and sole 2 are again formed as an integral moulding with the connection between the turntable 6 and sole 2 being defined by relatively thin annular web 30 extending around the outer edge of the turntable 6. The material from which the sole 2 and turntable 6 are moulded (for example a suitable elastomeric material) is such that the web 30 which connects the turntable 6 to the sole 2 will have sufficient resilience to enable the turntable 6 to rotate relative to the sole 2, such rotation being permitted by resilient deformation of the web 30. This may be facilitated by moulding the web 30 in a generally V-shaped cross-sectional configuration although other cross-sectional configurations may also achieve a similar effect. Advantageously the characteristics of the material are such that resilient deflection of the web 30 during rotation may provide a sufficient resilient bias to restore the turntable 2 to its original position following rotation from a rest position in each direction.

Mounted within the structure of the turntable 6 is a relatively soft support disc 68 to the underside of which is attached a metal plate 70 having a number of upwardly-extending threaded apertures 72 which lie within recesses 74 in the edge portion of the disc 68. The threaded apertures 72 serve to receive the threaded stems 76 of screw-in studs 78 which are screwed into the turntable 6 from the underside, the turntable 6 being formed with apertures 80 for passage of the stems 76 of the studs 78.

The sole 2 is attached to a relatively stiff backing plate 84 at its upper side whereby the assembly formed by the metal plate 70 and support disc 68 lies between the turntable 6 and backing plate 84, a disc 86 of relatively low friction material such as PTFE ("Teflon") being interposed between the upper surface of the disc 68 and under surface of the backing plate 84 to facilitate rotation of the rotating assembly formed by the turntable 6, plate 70, and support disc 68. The backing plate 84 carries a downwardly-projecting lug 88 extending through arcuate slots 90,92 in the low friction disc 86 and support disc 68 in order to restrict the extent of rotation of the turntable 6. By way of example, the extent of the arcuate slot 90,92 and projection 88 may be such as to restrict rotation of the turntable 6 through an angle of about 30° in each direction from the rest position.

A boss 94 projects upwardly from the surface of the turntable 6 through apertures in the plate 70 and discs 68,86 to be located in an aperture 96 in the backing plate 84. The boss 94, which lies on the axis of the turntable 6, cooperates with the aperture 96 in the backing plate 84 to ensure that the turntable 6 is constrained for rotation about its axis.

In the construction described with reference to FIG. 11, the use of the resilient web 30 to connect the turntable 6 to the sole 2 provides an absolute seal against the ingress of mud and dirt and which might impede rotation of the turntable 2. It also acts to provide a resilient bias to return the turntable 6 to its rest position, with the bias increasing with increasing rotation from the neutral position to provide an increasing dampening effect. If necessary the bias provided by the deflection of the web 30 may be supplemented by a biasing spring. The assembly of the support disc 68 and metal plate 70 within the turntable 6 provides a means of mounting replaceable screw-in studs notwithstanding the relatively thin structure of the turntable itself. Although it is preferred that the sole 2, turntable 6, and connecting web 30 are integrally formed in one piece it would alternatively be possible to form the turntable 6 and web 30 as an integral moulding and then bond the web 30 to the sole 2 which may be formed separately from a harder material.

In alternative embodiments the turntable 6 for use with the web 30 may be moulded with integral studs or fins or may be devoid of any such projections.

Figure 12:
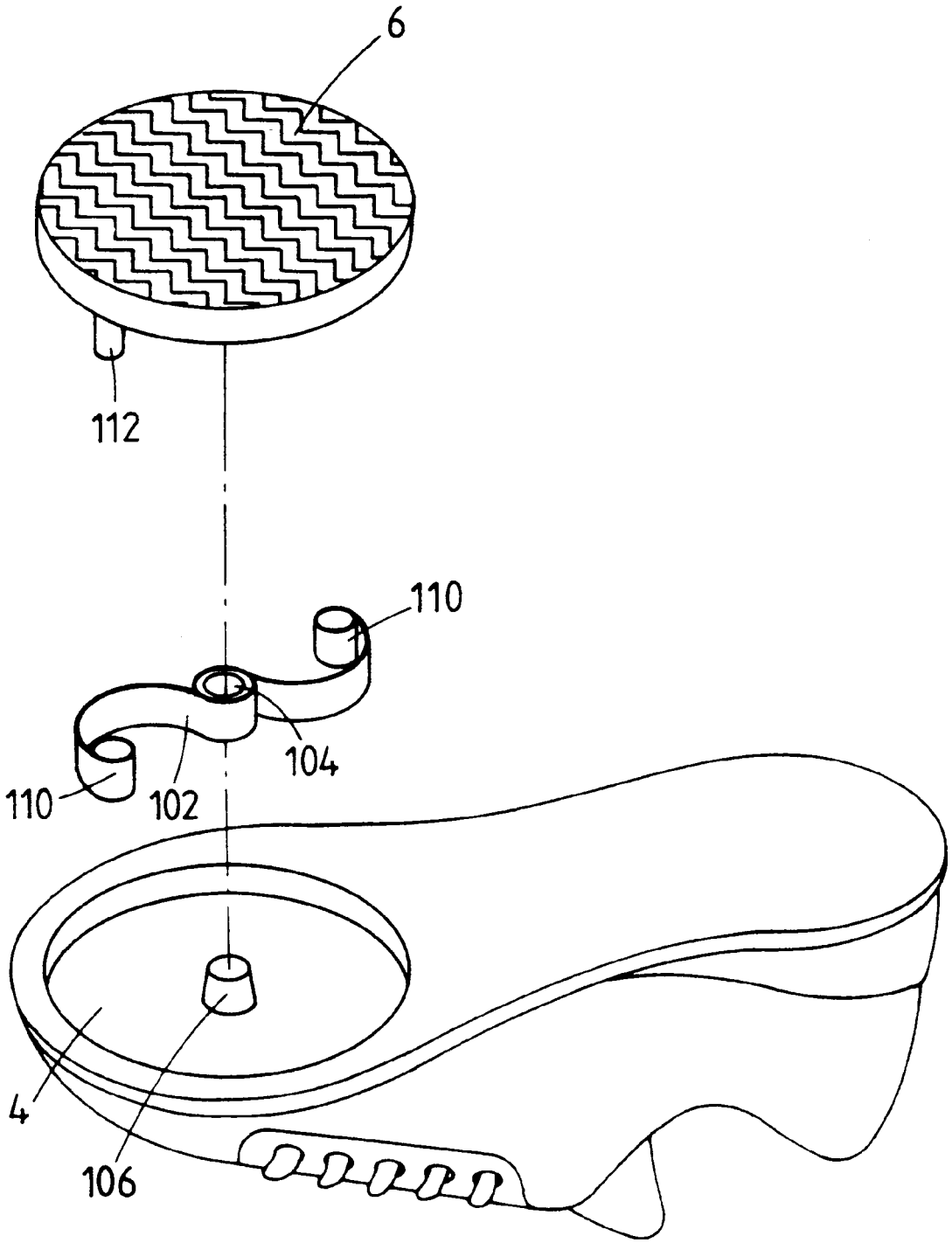
FIG. 12 is an exploded underneath perspective view of a sixth embodiment of the invention.
Figure 13:
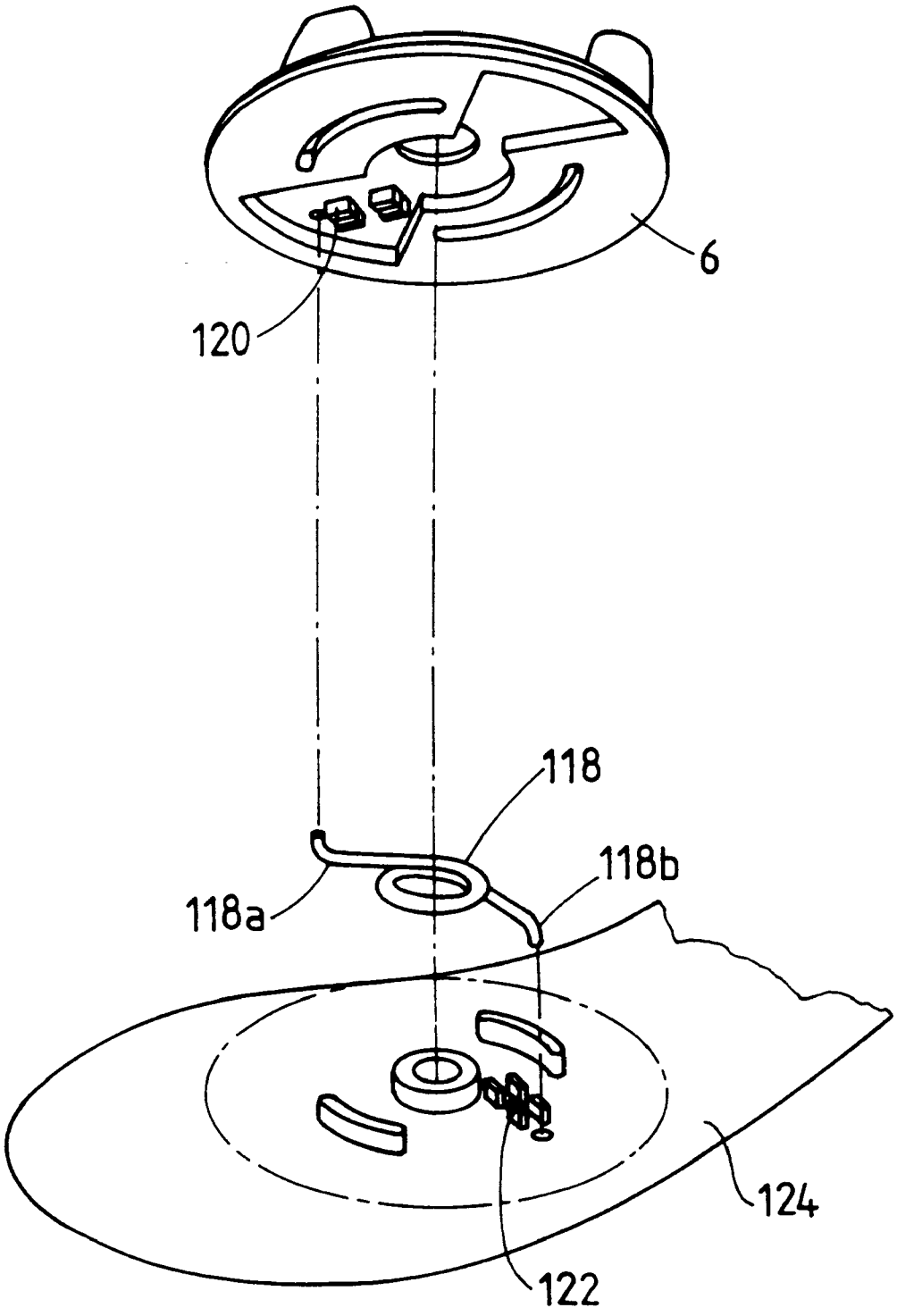
FIG. 13 is an exploded schematic view of a seventh embodiment of the invention.
Figure 14:
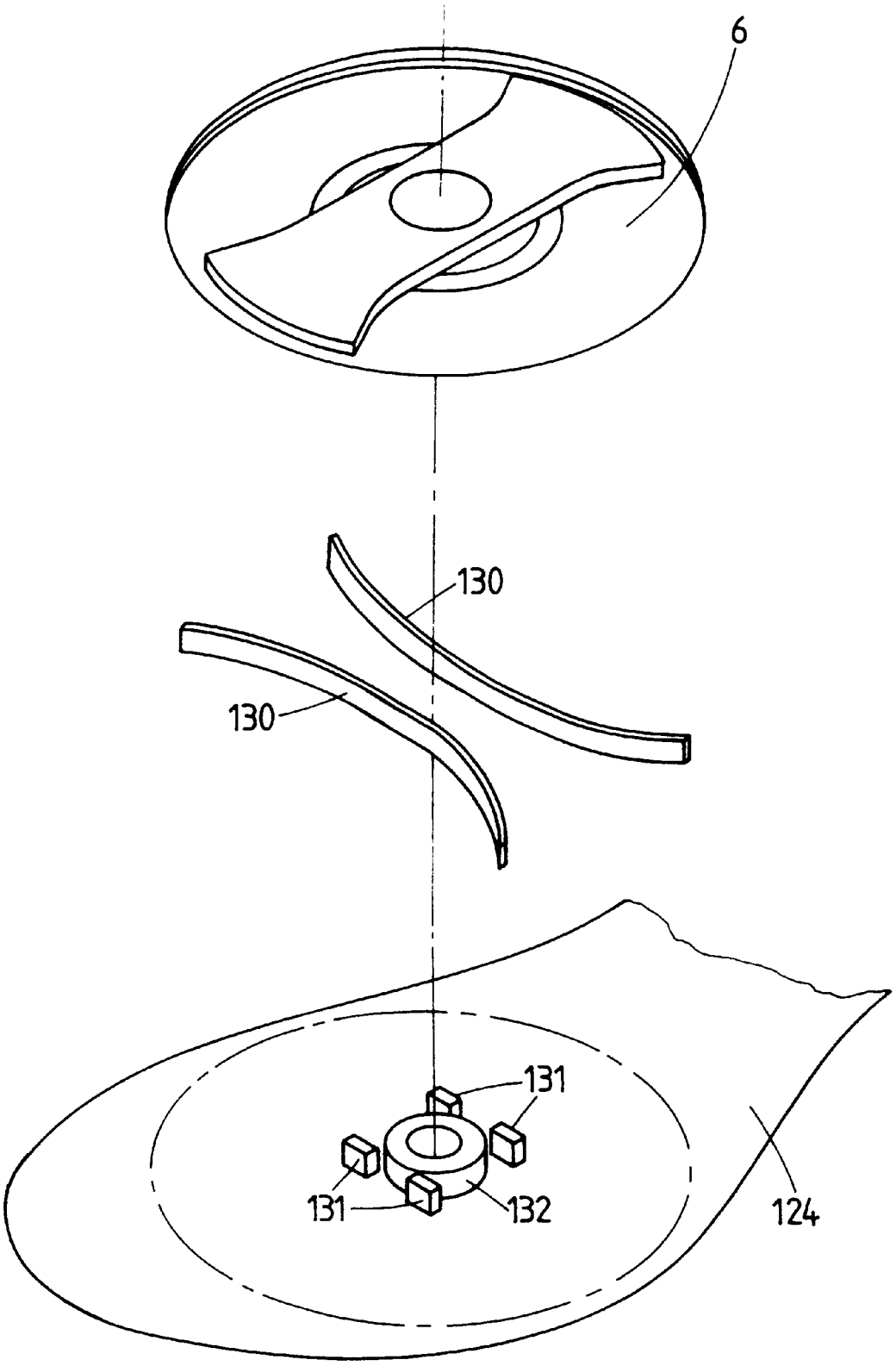
FIG. 14 is an exploded schematic view of an eighth embodiment of the invention.
Figure 15:
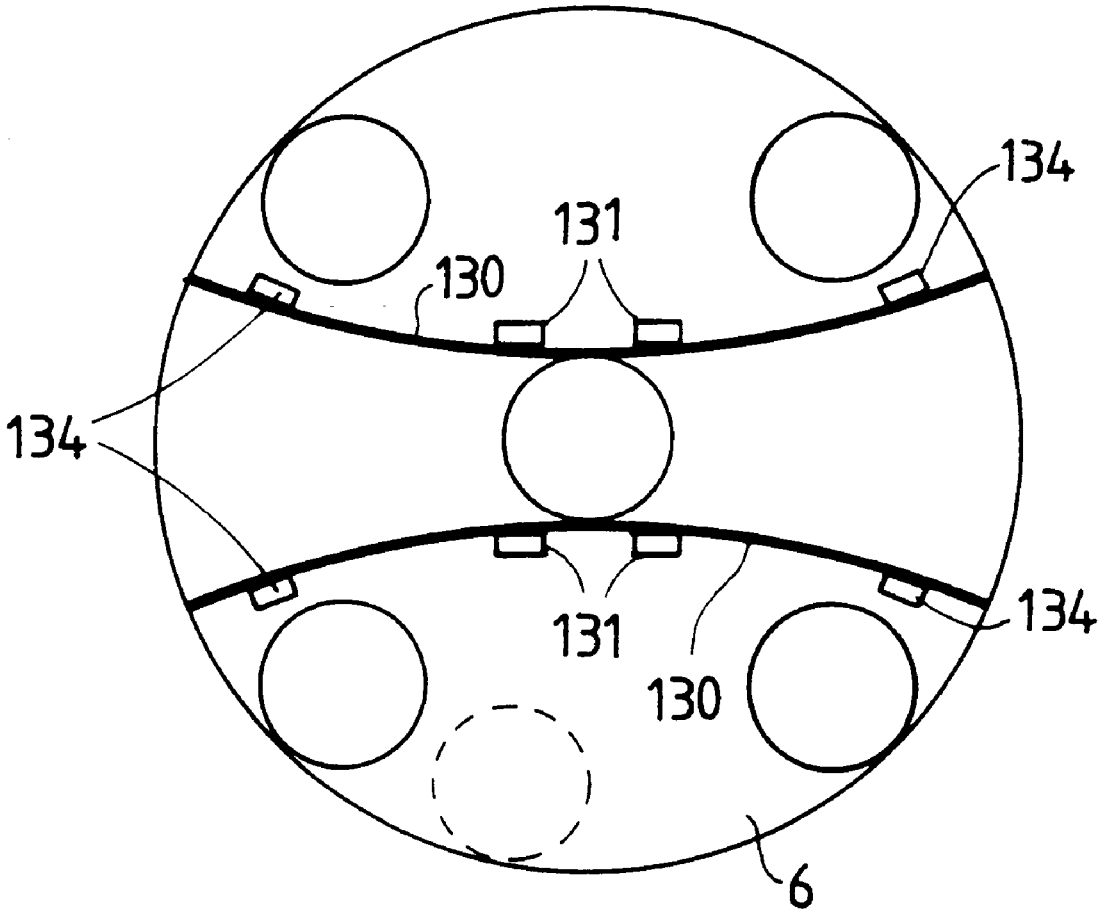
FIG. 15 is a plan view of the embodiment of FIG. 14.

The embodiments of FIGS. 12 to 15 utilize different forms of spring arrangement interposed between the turntable 6 and sole 2 to apply the resilient bias. In particular the spring may be a leaf spring, a spiral spring, or a twin coil spring or other form of spring to apply a torsional bias to the turntable 6. FIG. 12 illustrates a suitable leaf spring 102 formed into an S-shape, with the central portion 104 of the spring being mounted on a central boss 106 within the recess or cavity within the underside of the sole and being restrained against rotation relative to the sole, and the opposed end portions 110 of the spring 102 being shaped to receive projections 112 on the turntable 6. FIG. 13 shows a wire coil spring 118 with projecting arms 118*a*, 118*b* engageable respectively with projections 120 on the turntable 6 and projections 122 on a backing plate 124 which defines an upper wall of the cavity in the sole. FIGS. 14 and 15 show a spring arrangement comprising two separate leaf springs 130 which lie in facing relationship. The central portions of the two springs 130 are held by projections 131 adjacent a central boss 132 on the backing plate 124 and the outer ends of the springs 130 engage projections 134 on the turntable 6. In another arrangement (not shown), the spring may comprise an elastomeric band operating under tension between the turntable and the sole.

Figure 17:
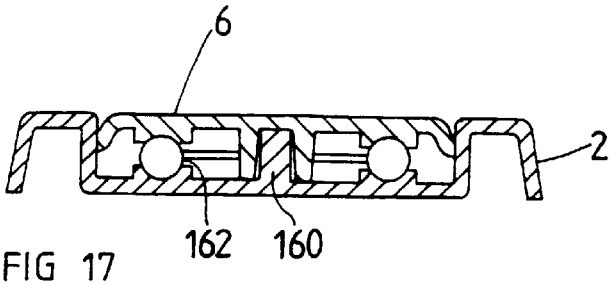
FIG. 17 is a transverse cross-section of the embodiment of FIG. 16.
Figure 16:
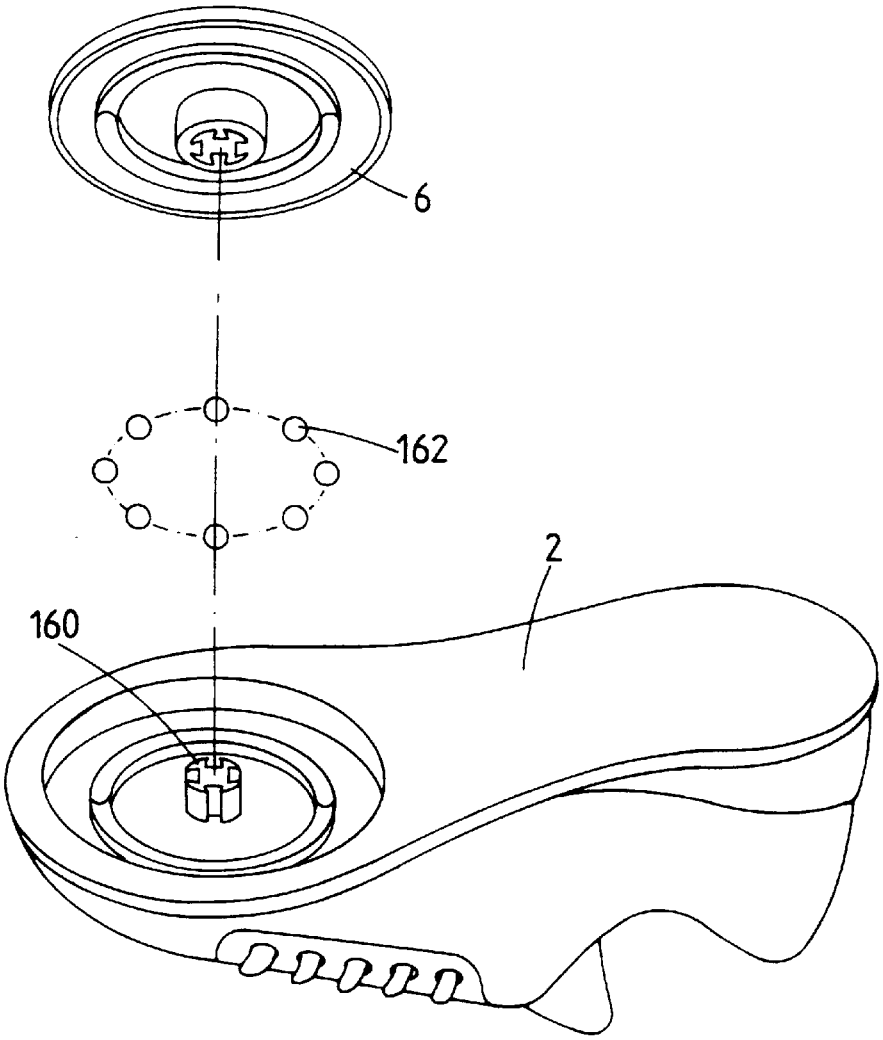
FIG. 16 is an exploded underneath perspective view of a ninth embodiment of the invention.

In the configuration shown in FIGS. 16 and 17 the resilient bias is applied to the turntable 6 by means of a torsional central boss or post 160 on which the turntable 6 is mounted. The boss 160, which is preferably formed integrally with the material of the sole, is such as to resiliently twist during relative rotation between the turntable and sole. Again, in this configuration the twisting of the boss 160 will provide increasing resistance to rotation as the angle of rotation increases in a generally similar manner to that which occurs when the resilient bias is provided by a foam filling within the cavity or by an elastomeric web. Also it will likewise provide a progressive damping effect. In this embodiment a caged ball race assembly 162 is interposed between the turntable 6 and sole in order to provide a good rotational bearing support for the turntable. The use of the torsional boss 160 does not, however, of necessity require the use of the illustrated bearing assembly 162, and the bearing assembly 162 can be used in many of the other embodiments described.

Figure 19:
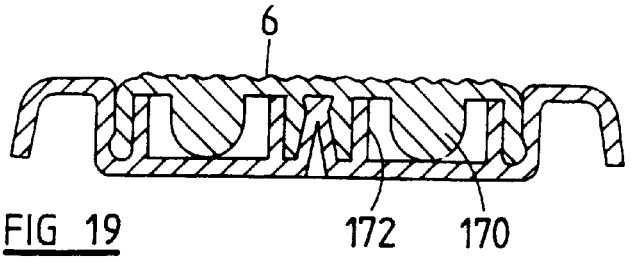
FIG. 19 is a transverse section of the embodiment of FIG. 18.
Figure 18:
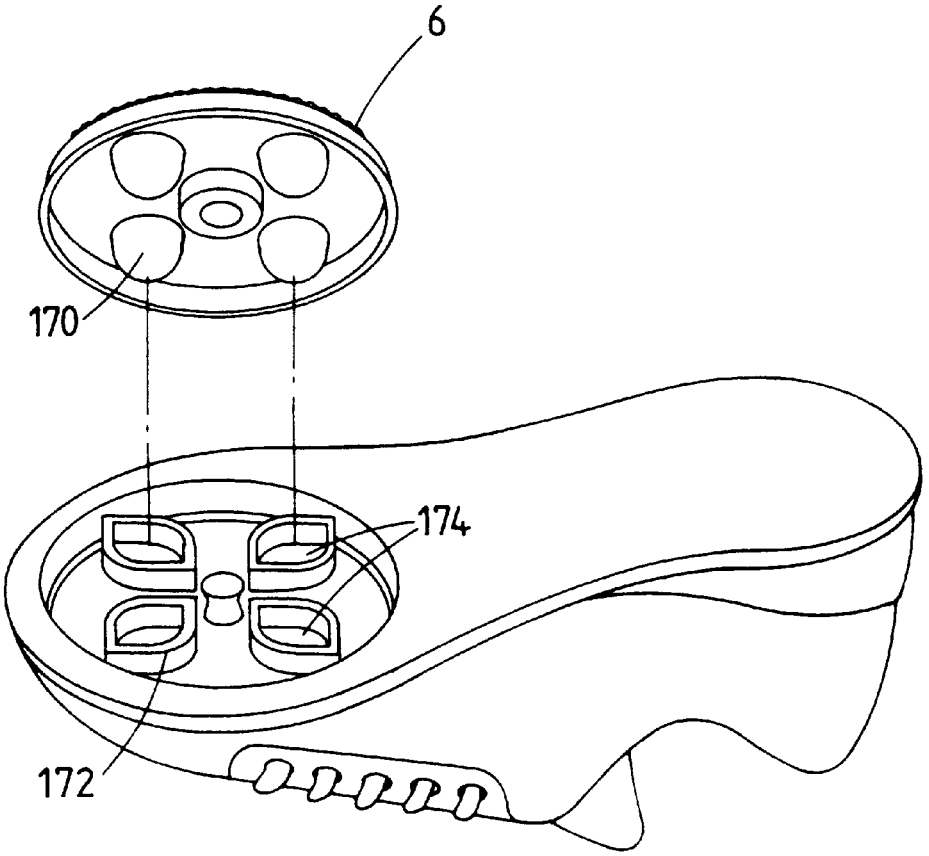
FIG. 18 is an exploded underneath perspective view of a tenth embodiment of the invention.

In the embodiment shown in FIGS. 18 and 19, the turntable 6 is provided with hemispherical projections 170 which engage the upper wall of the recess to provide effective bearing support for the turntable. In this embodiment the resilient bias is applied to the turntable by a series of elastomeric webs 172 interposed between the turntable and the recess by engagement of the hemispherical bearing projections 170 within a central opening 174 of each web 172.

Alternative bearing arrangements may involve the use of a bearing disc of a low friction material such as a disc of PTFE such as that sold under the trade mark "TEFLON" for supporting the turntable relative to the sole.

In each of the embodiments described herein and also in the embodiments described in the earlier applications, the turntable is of a circular disc-like shape. It is however not essential for the turntable to be of circular shape and other shapes such as elliptical or polygonal may be used. Clearly, however, the shape of the turntable and that of the recess in the sole within which it is mounted must be compatible with the requirement of the turntable being able to rotate through a predetermined angle (for example 30°) relative to the sole. However, for simplicity, a turntable of circular shape is preferred.

In each of the embodiments so far described and also in the embodiments of the earlier applications, relative rotation between the turntable and sole is through a restricted angle only, the turntable then being returned to its rest position under the effective resilient bias. In an alternative arrangement however it is possible for there to be a rotation through a series of discrete steps in each direction; by way of example only, such steps may each have an angular extent of about 30°. This effect may be achieved by means of a detent mechanism incorporated between the turntable and sole. The detent mechanism releasably locks the turntable in a predetermined angular position and when sufficient force is applied to release the lock, the relative rotation takes place through the predetermined angular extent and at the end of that movement the turntable is again releasably locked by means of the detent mechanism. The structure is such that the turntable cannot move past the next stop position until the foot has been removed from the ground and a subsequent force is then applied to the turntable on re-application of the foot to the ground.

For some applications, rotation of the turntable may be required only at certain selected times. In this case a lock can be incorporated to releasably lock the turntable against rotation, until such time that rotation is required whereupon the user may release the lock. In an alternative, the turntable may be locked against rotation until the pressure or force applied to the turntable by the wearer exceeds a predetermined limit. In either case, the turntable may be subject to a resilient bias to return it to its original position or may be capable of rotation through discrete steps, by means of any of the systems described herein. In the form where release of the turntable from locking restraint occurs in response to pressure or force exerted by the wearer, the value of that pressure or force may be capable of manual adjustment by the user.

In each of the forms described herein and in the earlier applications, the turntable may carry studs or spikes which may be removable and replaceable. Alternatively the turntable may carry integral projecting fins, ribs, or other structure to provide required non-slip contact with the ground. As will be appreciated, the form of the studs, fins or other structure carried by the turntable will largely depend on the intended use of the footwear; if the footwear is intended to be used for a field sport such as football, the turntable will be provided with suitable studs, spikes or fins, whereas if it is to be used for a sport such as squash, tennis, or badminton, the turntable will carry smaller fins or other projections which will provide a non-slip grip with the court, without damaging the surface of the court.

Figure 21:
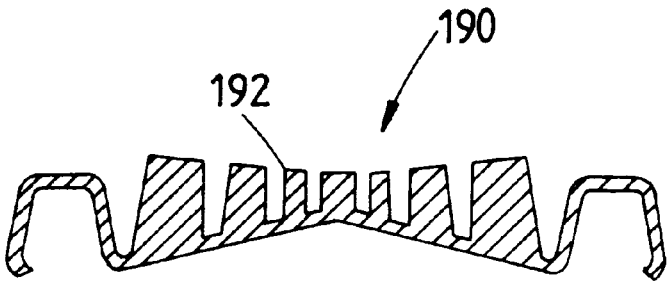
FIG. 21 is a transverse section of the embodiment of FIG. 20.
Figure 20:
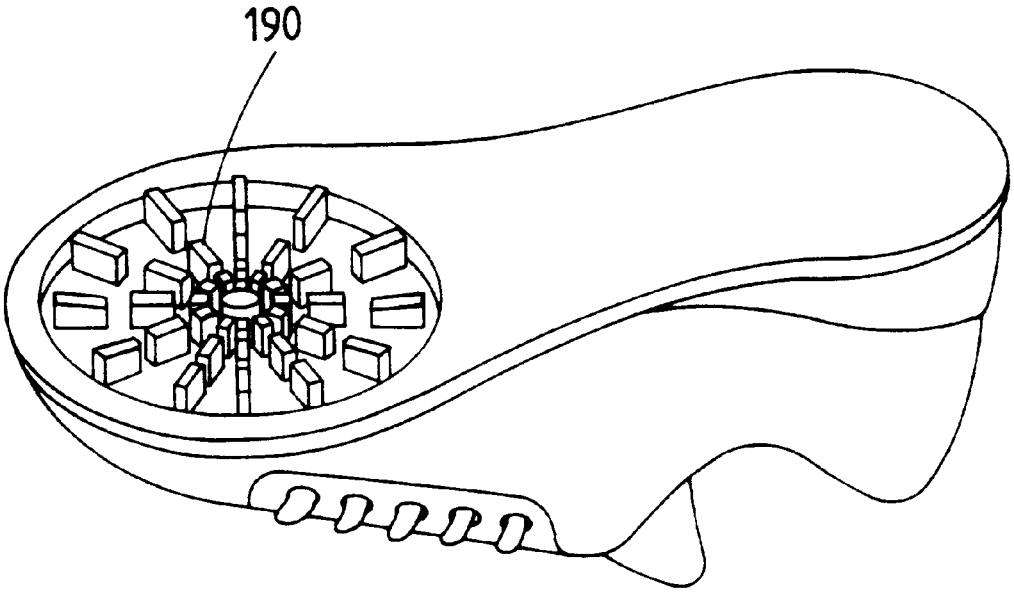
FIG. 20 is an underneath perspective view of an eleventh embodiment of the invention.

In another alternative arrangement as shown in FIGS. 20 and 21, instead of incorporating a turntable which is able to rotate relative to the remainder of the sole, the sole incorporates a zone 190 which, as shown, is circular but alternatively may be of other appropriate shape, incorporating an array of flexible fins 192 or other projections which are able to flex in such a manner as to allow limited rotation of the sole around the zone of contact of the fins or projections with the ground. In other words, the effect is similar to that which is provided by the incorporation of the turntable whereby the sole is able to rotate through a limited angle relative to the turntable when the latter is in contact with the ground, but instead obviates the need to incorporate a rotatable structure within the sole to achieve this effect. As shown, the fins or projections 192 are arranged in a series of angularly spaced, radially-extending rows extending from the centre of the generally circular zone, although it is conceivable that other configurations could be used to achieve a similar effect. The fin or projections 192 are moulded integrally with the remainder of the sole and in operation the fins or projections will deform with a twisting motion as the sole rotates about the tips of the fins or projections. As the extent of twisting increases, the resistance to motion of the sole will increase and this will provide a progressive damping effect and will also act as a limit to the extent of rotation of the sole.

Figure 22:
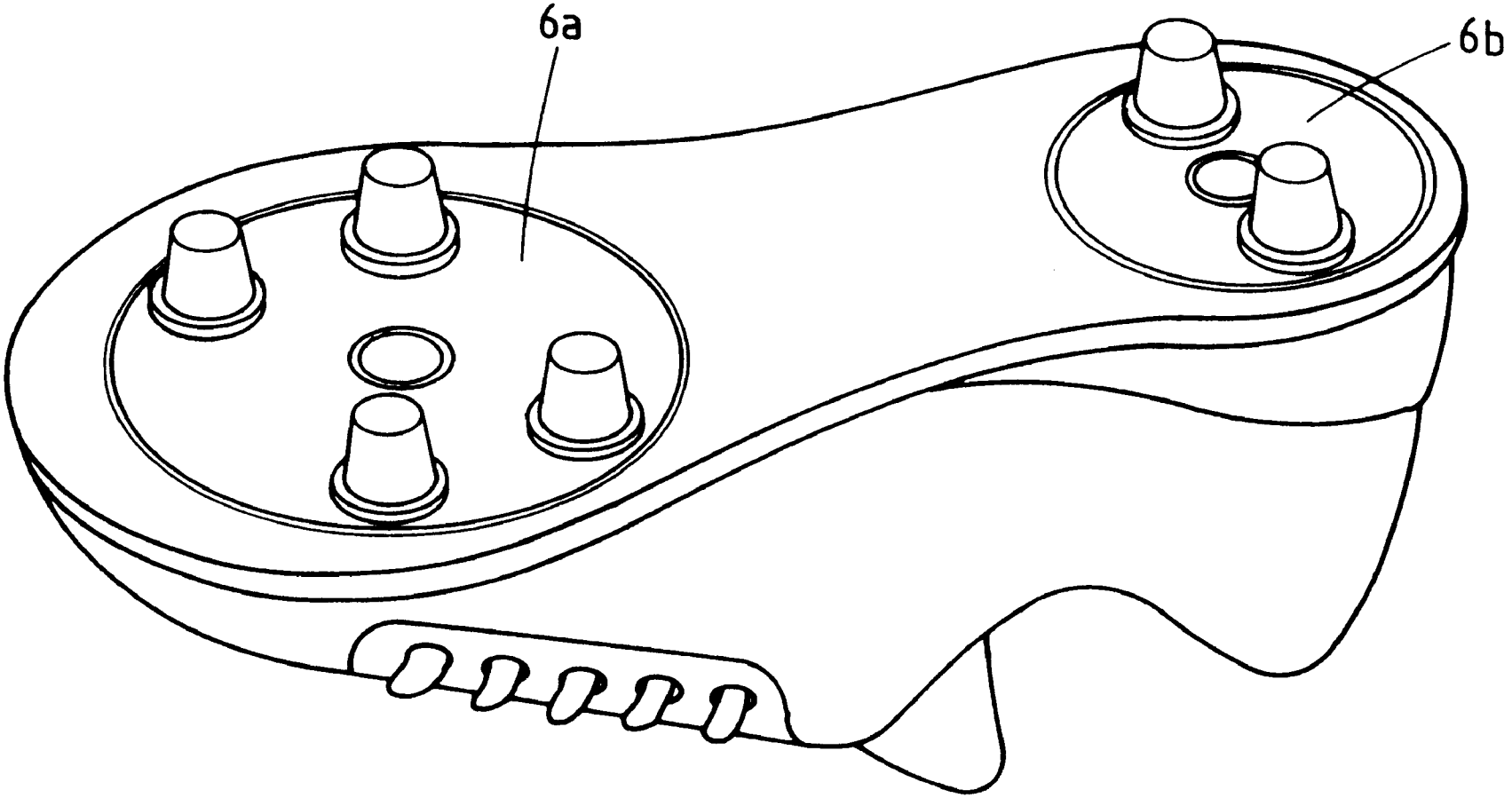
FIG. 22 is an underneath perspective view of a twelfth embodiment of the invention.
Figure 23:
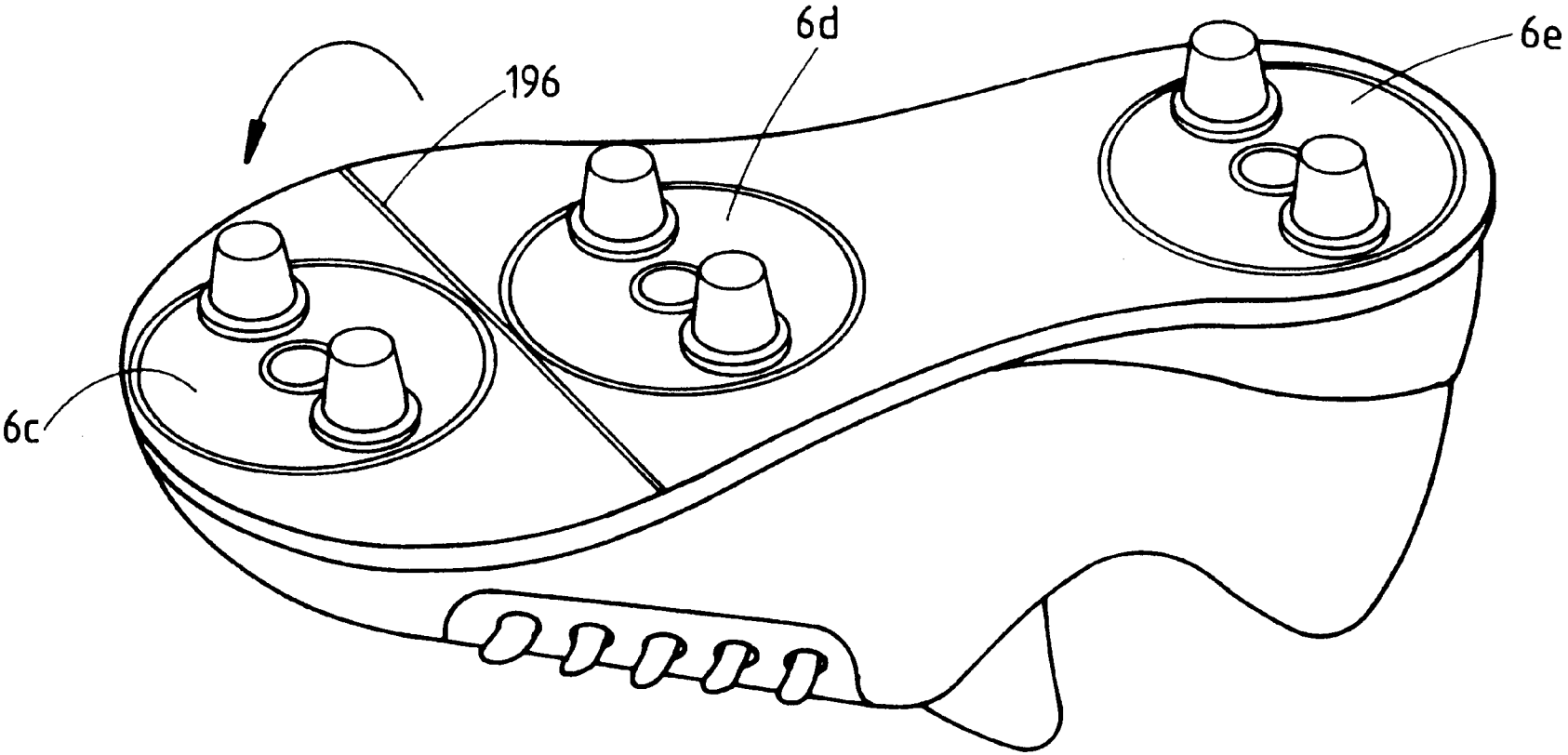
FIG. 23 is an underneath perspective view of a thirteenth embodiment of the invention.

Although as described thus far and also in the earlier applications the turntable or other structure which permits restricted rotation of the sole relative to the ground is incorporated within the part of the sole beneath the ball of the foot, it may alternatively be positioned on other parts of the sole such as the toe part or heel part, and it is also possible for more than one such turntable or other such structure to be incorporated. By way of illustration in FIG. 22, there is illustrated a shoe sole having turntables 6*a*, 6*b* on the ball part of the sole and on the heel part, respectively. In FIG. 23 there is illustrated a shoe sole having a first turntable 6*c* in the toe part of the sole, a second turntable 6*d* immediately behind that and a third turntable 6*e* in the heel part. The first and second turntables 6*c,* 6*d* are located either side of a flex zone 196 of the sole which ensures that at any one time one or other of these two turntables will be in contact with the ground.

In shoes where more than one turntable or other comparable store is incorporated as just described, each turntable is capable of rotation through a rested angle relative to the sole and may take any of the forms previously described in this application or in the earlier applications. The function of the turntable may alternatively be assumed by an array of deformable fins or projections of the general type discussed with reference to FIGS. 20 and 21 and it is possible to utilise one or more turntables in conjunction with one or more zones of such deformable fins or projections.

The various embodiments have been described by way of example and modifications are possible within the scope of the various concepts disclosed herein.

What is claimed is:

1. A sole for footwear, the sole having a recess in which is mounted a turntable for rotation in opposing directions of rotation from a rest position, said turntable having an outer periphery separated from the sole by an annular space, and a resiliently deformable sealing structure of annular form extending around said outer periphery of the turntable and closing said space against ingress of dirt and mud, said resiliently deformable structure being attached to the sole and to the periphery of the turntable such that rotation of the turntable relative to the sole results in resilient deformation of the sealing structure, said deformation applying a resilient bias to the turntable acting in a direction to return the turntable to said rest position after rotation.

2. The sole of claim 1, wherein the sealing structure comprises an annular web extending between the periphery of the turntable and the sole.

3. The sole of claim 1, wherein the sealing structure comprises a filling of resilient foam within a cavity defined between the turntable and recess, said foam filling being bonded to the periphery of the turntable and to a peripheral wall of the recess.

4. The sole according to claim 2, further comprising a spring associated with the turntable for applying additional resilient bias to return the turntable to said rest position after rotation.

5. The sole according to claim 3, further comprising a spring associated with the turntable for applying additional resilient bias to return the turntable to said rest position after rotation.

6. A sole for footwear, said sole including a turntable mounted within the sole for rotation in opposing directions of rotation from a rest position, said turntable having an outer periphery, the outer periphery of the turntable being connected to the sole via an annular web which surrounds the outer periphery of the turntable being connected to the sole via an annular web which surrounds the outer periphery of the turntable and which is bonded at a radially inner side to the turntable and at a radially outer side to the sole, said annular web providing a seal between the turntable and sole to prevent ingress of dirt and mud between the turntable and sole and said web being resiliently deformable upon rotation of the turntable from the rest position to provide to the turntable a resilient bias acting to return the turntable to the rest position.

7. The sole of claim 6, wherein the web is shaped in a generally V-shaped cross-section to define a groove which is open to an underside of the sole and which lies between the periphery of the turntable and the sole.

8. A sole for footwear, said sole including a turntable which is mounted for rotation in opposing directions of rotation from a rest position, said turntable having an outer periphery which is connected to a remainder of the sole by an annular web of resilient material which extends around the outer periphery of the turntable, the turntable, web, and sole being integrally formed, said annular web forming a seal between the turntable and sole to prevent ingress of dirt and mud, said annular web being shaped to define an annular groove which surrounds the periphery of the turntable and opens to an underside of the sole, said groove accommodating deformation of the web when relative rotation takes place between the turntable and sole, said deformation which takes place upon such relative rotation being a resilient deformation which acts to provide a resilient bias to return the turntable to the rest position.

* * * * *